US005779605A

United States Patent [19]

Tu

[11] Patent Number: 5,779,605

[45] Date of Patent: Jul. 14, 1998

[54] BODY-BUILDING MACHINE

[76] Inventor: Ming-Tsang Tu, 7 Fl., No. 96, Jen-ai 1st St., Kaohsiung, Taiwan

[21] Appl. No.: 922,427

[22] Filed: Sep. 3, 1997

[51] Int. Cl.[6] ..... A63B 21/02

[52] U.S. Cl. ..... 482/122; 422/126; 422/121

[58] Field of Search ..... 422/44, 49, 121, 422/122, 126

[56] References Cited

U.S. PATENT DOCUMENTS

| | | | |
|---|---|---|---|
| D. 208,787 | 10/1967 | Bennstrom-Prescott | 482/122 |
| 2,529,347 | 11/1950 | Mohler et al. | 482/126 |
| 3,349,621 | 10/1967 | Mullen | 482/126 |
| 4,022,463 | 5/1977 | Scott, Jr. | 482/121 |
| 4,268,032 | 5/1981 | Cusi | 482/122 |
| 4,332,380 | 6/1982 | Cardin | 482/126 |
| 4,513,962 | 4/1985 | Robson et al. | 482/49 |
| 4,756,522 | 7/1988 | Sandoval | 482/44 |
| 5,425,690 | 6/1995 | Chang | 482/121 |
| 5,690,596 | 11/1997 | Parker | 482/126 |

*Primary Examiner*—Lynne A. Reichard
*Attorney, Agent, or Firm*—Kirkpatrick & Lockhart LLP

[57] ABSTRACT

A body-building machine includes a locating frame having an head portion integrally formed at a top thereof. The head portion defines an open chamber and a pair of opposed holes at two side walls thereof. A locating plate having an inclined end portion is inserted into the open chamber and is received in the locating frame. A pair of tubular lugs are formed at an intersection between the locating plate and the inclined end portion, aligning with the pair of opposed holes. A cladding plate having a plank with an angled portion is received in the open chamber. A tube is formed at an intersection between the plank and the angled end portion, aligning with the tubular lugs. A shaft extends through the opposed holes, the pair of tubular lugs and the tube to engage the locating plate with the plank and to form a short tension arm above shaft and a long tension arm below the shaft. An elastic return mechanism is disposed between the inclined end portion and the angled end portion in the short tension arm portion.

9 Claims, 8 Drawing Sheets

BODY-BUILDING MACHINE

BACKGROUND OF THE INVENTION

1. Field of the Invention

The present invention relates to a body-building machine, and more particularly to a body-building machine with a simple structure, a small volume and multiple functions.

2. Description of Related Art

In general, body-building machines are popularly used in the modern society. Since they are movable and do not occupy a large space, the body-building machines enable people to exercise indoors. However, conventional body-building machines are generally designed to be adapted for only one kind of exercise, that is, each body building machine is designed only to work out a specific part of the body, such as arms, legs, abdomen. These body-building machines are not satisfactory for the purpose of building the whole body. Later, one kind of body-building machine with multiple functions has been developed. However, this body-building machine always has a complex structure, therefore, it is difficult to operate it and has a high cost. Furthermore, this body-building machine occupies a large space.

The present invention provides an improved body-building machine to mitigate and/or obviate the aforementioned problems.

SUMMARY OF THE INVENTION

One object of the present invention is to provide a body-building machine with a simple structure, a small volume and multiple functions.

In accordance with one aspect of the present invention, the body-building machine comprises a locating frame, a locating plate, a cladding plate, a shaft and an elastic return means. The locating frame has a head portion integrally formed at a top thereof. The head portion defines an open chamber therein and a pair of opposed holes respectively in two side walls thereof. The locating plate is inserted into the open chamber of the head portion and is received in the locating frame. The locating plate includes a body with an inclined end portion extending therefrom and a pair of tubular lugs formed at an intersection between the body and the inclined end portion. Passages in the tubular lugs align with the pair of opposed holes. The cladding plate includes a plank with an angled end portion extending therefrom. A tube is formed at an intersection between the plank and angled end portion. The tube aligns with the tubular lugs of the locating plate. The angled end portion of the cladding plate is received in the open chamber of the head portion of the locating frame. The shaft is inserted through the opposed holes of the locating frame, the pair of tubular lugs of the locating plate and the tube of the angled end portion to engage the inclined end portion with the angled end portion whereby a short tension arm is formed above the intersections of the locating plate and the cladding plate, and a long tension arm is formed below the intersection of the locating plate and the cladding plate. The elastic return means is disposed between the inclined end portion of the locating plate and the angled end portion of the cladding plate in the short tension arm portion.

In accordance with another aspect of the present invention, the inclined end portion of the locating plate and the angled end portion of the plank define a pair of opposed recesses respectively in an outer periphery thereof for a belt to wind therearound, and a plurality of opposed holes through which a corresponding number of extension springs are mounted.

In accordance with a further aspect of the present invention, the body-building machine further includes a cover disposed on the head portion of the locating frame and engagedly received in a pair of channels defined at outer periphery of two side walls of the head portion.

In accordance with still a further aspect of the present invention, the locating frame further defines a pair of holes at a bottom thereof, and the locating plate has a sleeve formed at a bottom thereof aligning with the pair of holes of the locating frame for a rod to extend therethrough, thereby engaging the locating plate to the locating frame.

Other objects, advantages and novel features of the invention will become more apparent from the following detailed description when taken in conjunction with the accompanying drawings.

DETAILED DESCRIPTION OF PREFERRED EMBODIMENT

Figure 1:
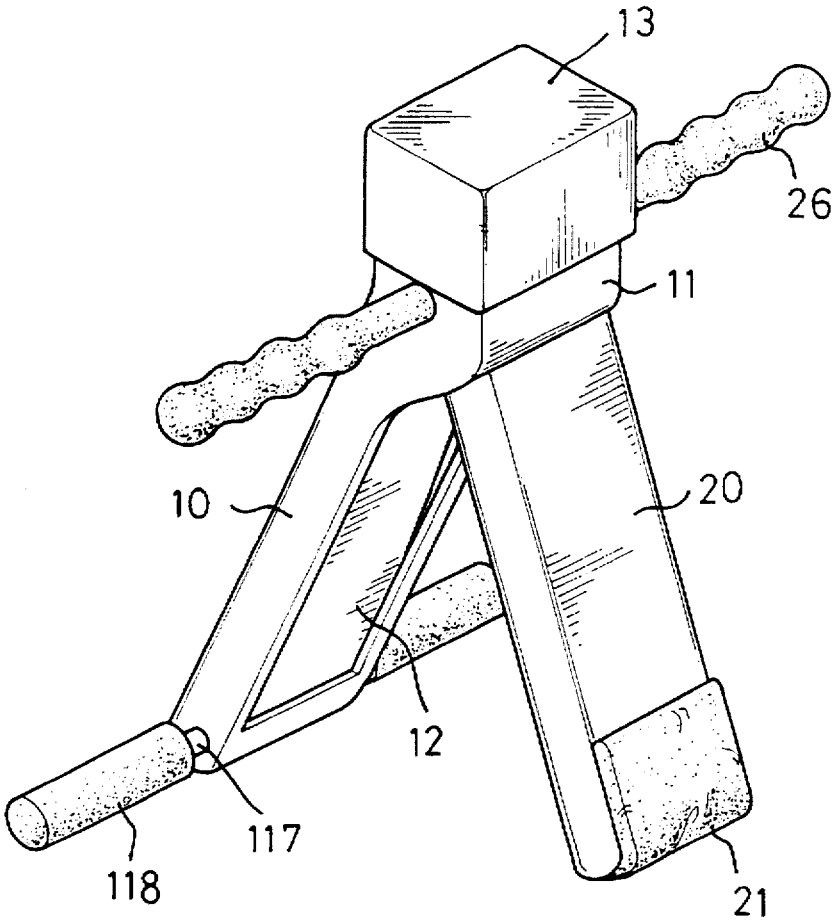
FIG. 1 is a perspective view of the body-building machine in accordance with the present invention.
Figure 2:
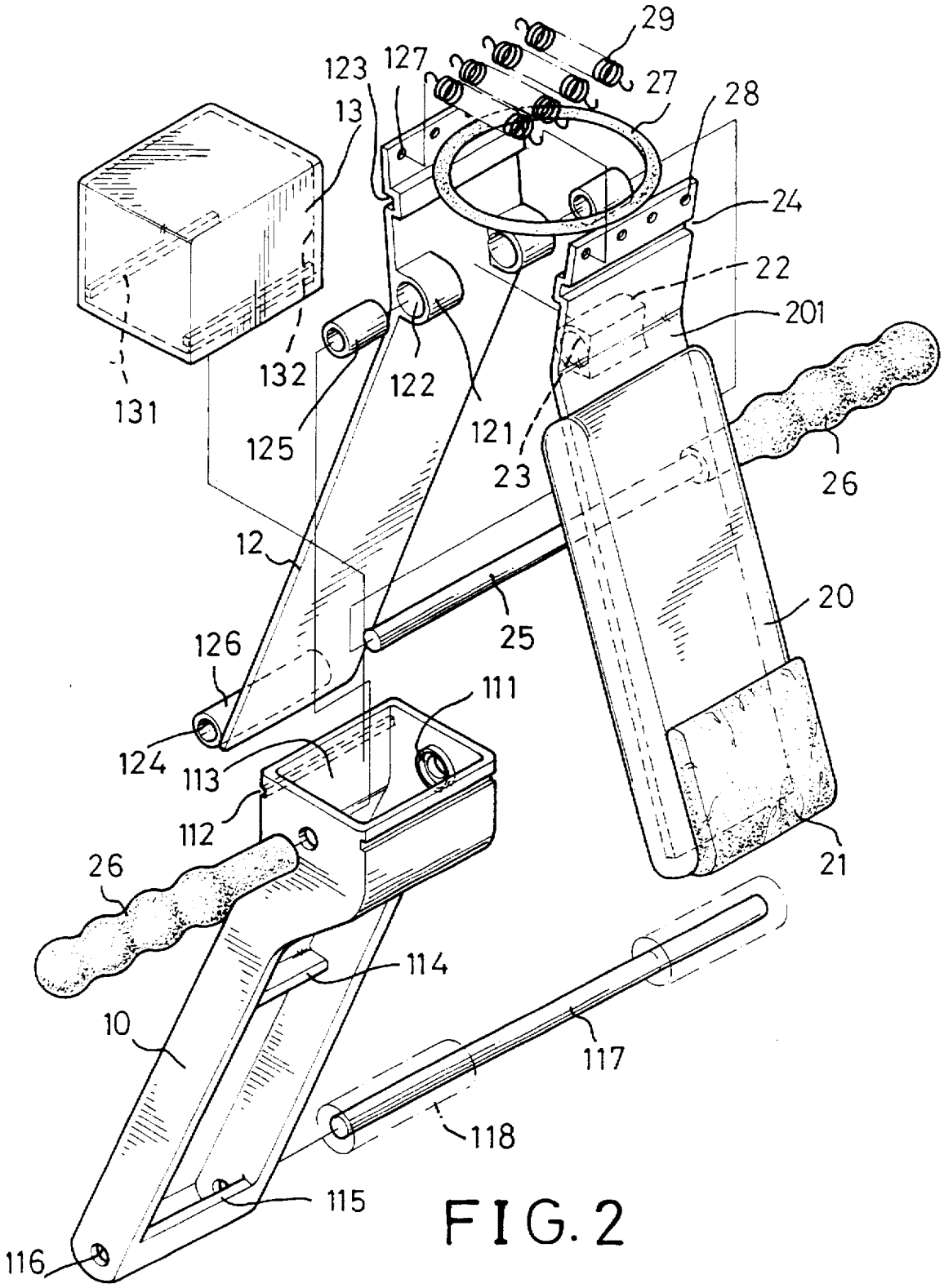
FIG. 2 is an exploded view of the body-building machine in accordance with the present invention.
Figure 3:
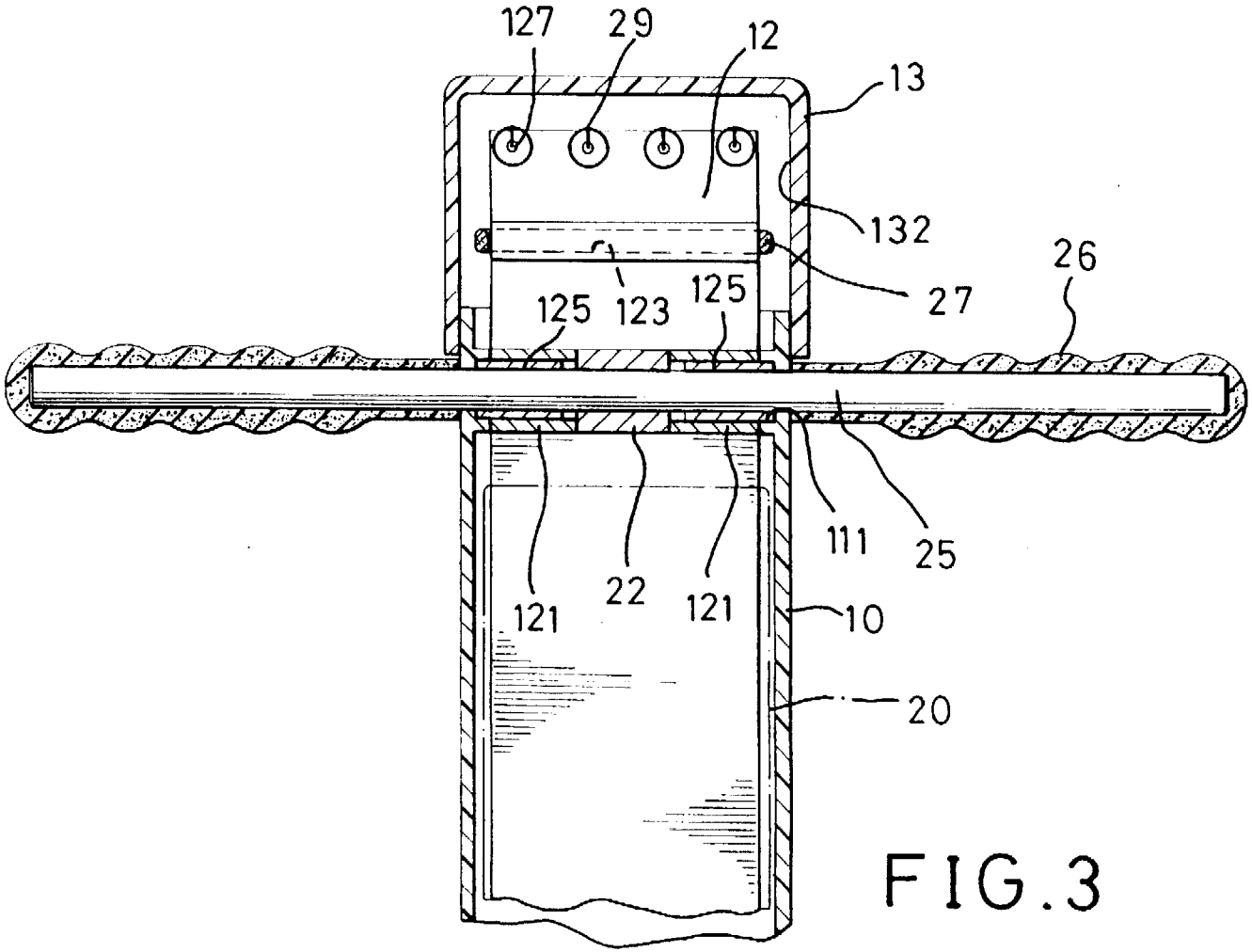
FIG. 3 is a partial sectional view of the body-building machine in accordance with the present invention.

Referring to FIG. 1 and FIG. 2, a body-building machine in accordance with the present invention includes a locating frame 10. The locating frame 10 integrally forms a head portion 11 at a top thereof and two side plates (not numbered). The head portion 11 defines an open chamber 113 therein, a pair of opposed stepped holes 111 at a first pair of opposed side walls thereof, and two opposite channels 112 at an outer periphery of a second pair of opposed side walls thereof. The locating frame 10 further has a first retainer 114 formed at a middle portion between the two side plates thereof and a second retainer 115 staggered to the first retainer 114 at a bottom thereof between the two side plates. Two opposed apertures 116 are respectively defined in the two side plates at a bottom thereof.

A locating plate 12 extends from the open chamber 113 of the head portion 11 of the locating frame 10 to the second retainer 115 via the first retainer 114. The locating plate 12 has includes a body with an inclined end portion (not numbered) extending therefrom and a pair of tubular lugs 121 formed at an intersection between the inclined end portion and the body. Each tubular lug 121 defines a through hole 122 therein to receive a sleeve 125. Each sleeve 125 and through holes 122 aligns with the pair of opposed stepped holes 111 of the head portion 11. The locating plate 12 further has a pipe 126 formed at a bottom thereof. The pipe 126 defines a central hole 124 aligning with the opposed apertures 116 of the locating frame 10, therefore, a rod 117 can extend through the pipe 126 and the opposed apertures 116 of the locating frame 10 to secure the locating plate 12 to the locating frame 10. A pair of sheathings 118 can be mounted respectively on two ends of the rod 117 extending from the locating frame 10 to provide a protection effect.

The body-building machine further includes a cladding plate 20 having a plank 201. Additionally referring to FIG. 4, the cladding plate 20 defines a long hole 203 at a top thereof and a blind hole 204 at a bottom thereof so that a bottom end of the plank 201 can be extended through the long hole 203 and received in the blind hole 204. The plank 201 has an angled end portion angled in a direction opposite to the inclined end portion of the locating plate 12 and has a tube 22 extending from an intersection between the plank and the angled end portion. The tube 22 defines a hole 23 therein aligning with through holes 122 of the lugs 121 of the locating plate 12. The angled end portion of the cladding plate 20 is received in the open chamber 113 of the head portion 11 of the locating frame 10. A pad 21 is mounted on a bottom of the cladding plate 20 to provide a protection effect.

A shaft 25 is inserted through the opposed stepped holes 111 of the locating frame 10, two sleeves 125 of the pair of tubular lugs 121 of the locating plate 12 and the hole 23 of the tube 22 of the angled end portion of the plank 201 to engage the locating plate 12 with the plank 201, and the head portion 11 of the locating frame 10. Therefore, a short tension arm is formed above the shaft 25 and a long tension arm is formed below the shaft 25. The shaft 25 may have a pair of handles 26 respectively mounted on two ends extending from the head portion 11 of the locating frame 10.

Furthermore, the inclined end portion of the locating plate 12 and the angled end portion of the plank 201 respectively define a pair of opposed recesses 123, 24 in an outer periphery thereof above the shaft 25 and a plurality of pairs of opposed holes 127, 28 in an upper portion thereof. Thereby, an elastic return means (not numbered) can be mounted between the inclined end portion of the locating plate 12 and the angled end portion of the plank 201 above the shaft. The elastic return means includes a belt 27 embedded in the recesses 123, 24 of the inclined end portion and the angled end portion, and a corresponding number of extension springs 29 mounted to the pairs of opposed holes 127, 28.

Additionally, a cover 13 defining a space 132 therein is mounted on the head portion 11 of the locating frame 10. The cover 13 forms a pair of ribs 131 respectively and engagedly received in the two opposite channels 112 of the head portion 11 of the locating frame 10. The space 132 defined in the cover 13 is provided for receiving the short tension arm portion of the inclined end portion of the locating plate 12 and the angled end portion of the plank 201.

In assembly, the two sleeves 125 are firstly disposed in the two tubular lugs 121 of the locating plate 12. Then the locating plate 12 is extended through the locating frame 10 from the head portion 11 thereof and is located between the first retainer 114 and the second retainer 115 by the rod 117. Next, the angled end portion of the plank 201 is inserted upward to the head portion 11 and the tube 22 thereof is aligned with the tubular lugs 121. Then the shaft 25 is extended through the tubular lugs 121, the tube 22 and the stepped holes 111 of the head portion 11 to mount the locating plate 12 and the plank 201 to the locating frame 10. At this time, the two handles 26 can be mounted respectively to the ends of the shaft 25 extending from the head portion 11. Thereafter, the elastic return means is mounted between the inclined end portion of the locating plate 12 and the angled end portion of the plank 201 in the above-mentioned manner. Finally, the cover 13 is mounted to the head portion 11 of the locating frame 10. In this way, an improved body-building machine as shown in FIG. 1 and FIG. 4 is obtained.

Figure 4:
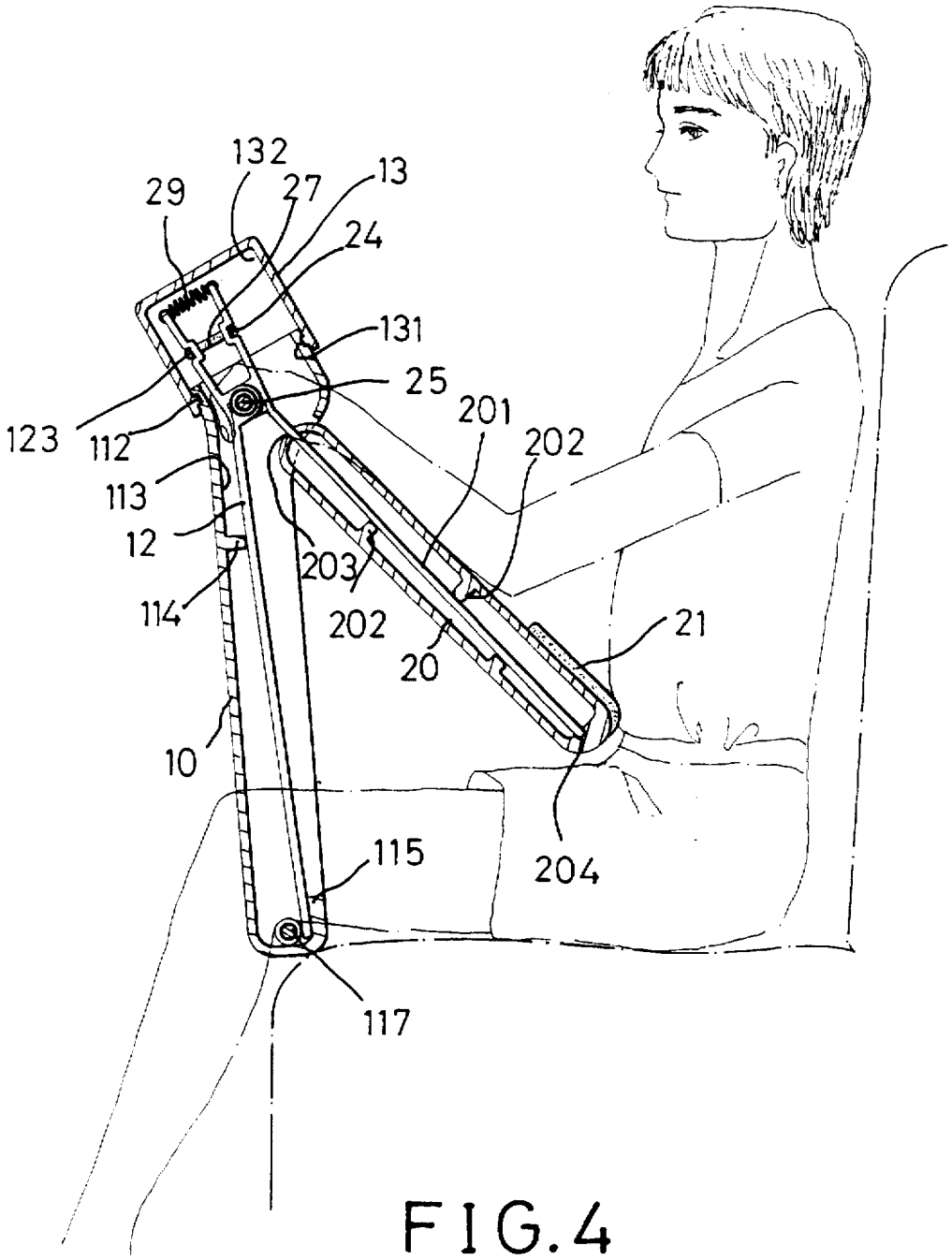
FIG. 4 is a sectional side view of the body-building machine in accordance with the present invention.
Figure 5:
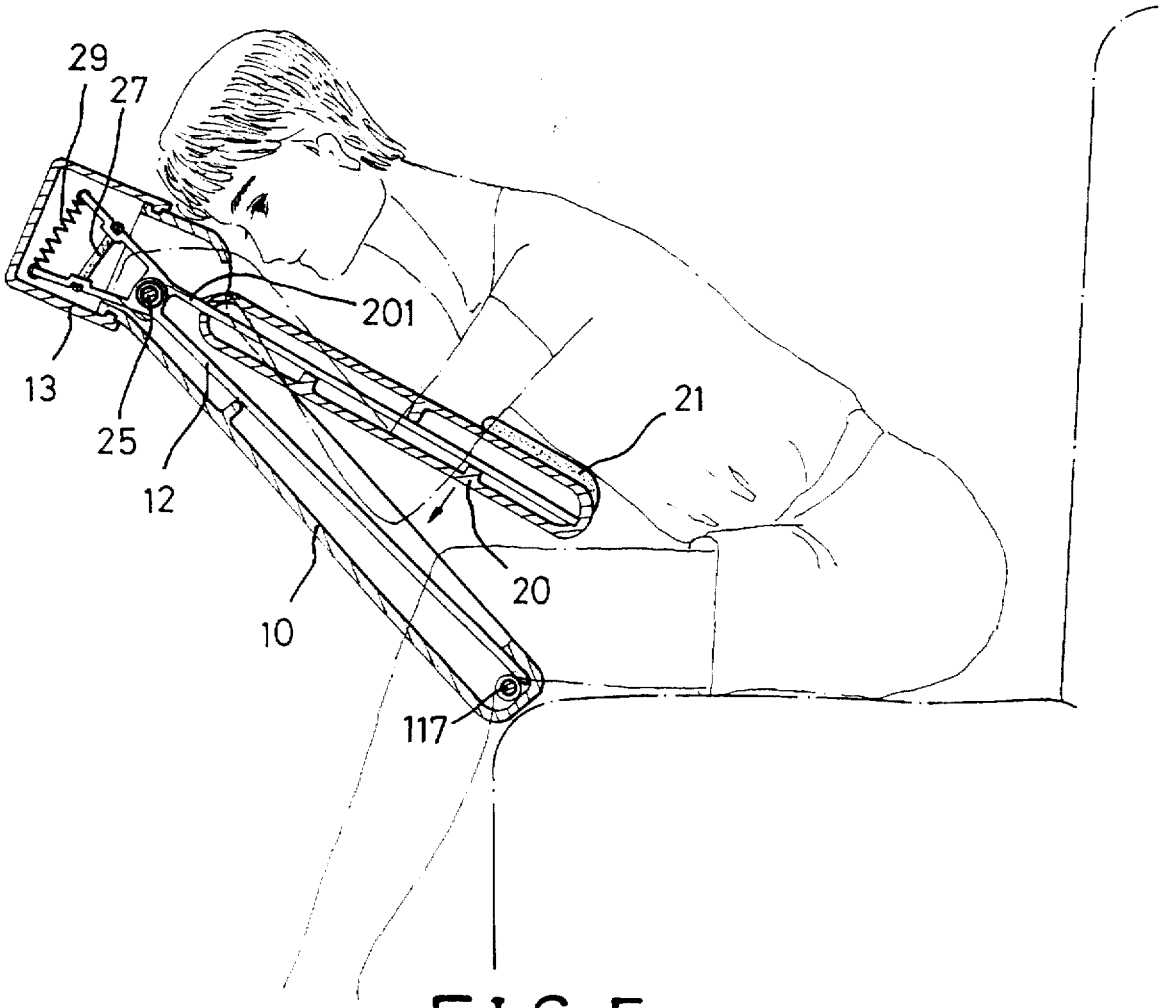
FIG. 5 is a side view showing the operation of the body-building machine in accordance with the present invention.
Figure 6:
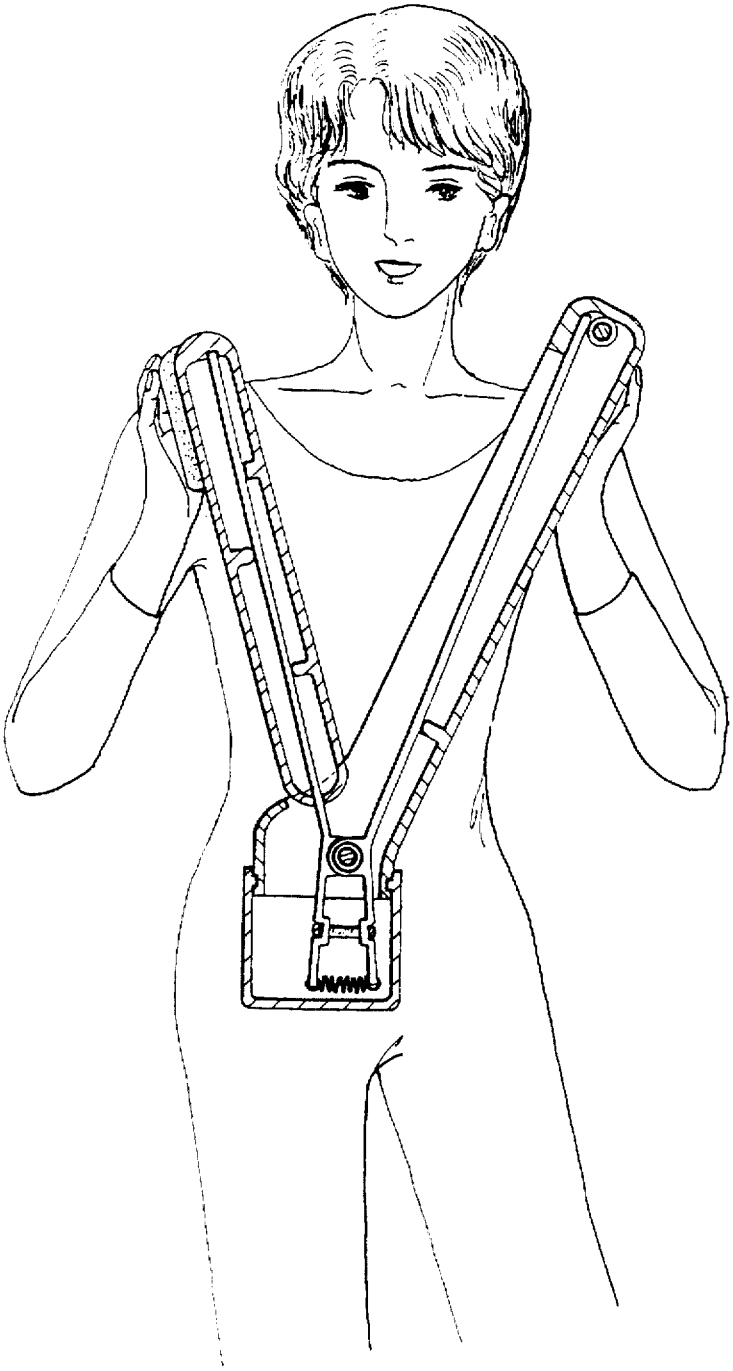
FIG. 6 is a first schematic view showing the operation of the body-building machine in accordance with a preferred embodiment present invention.
Figure 7:
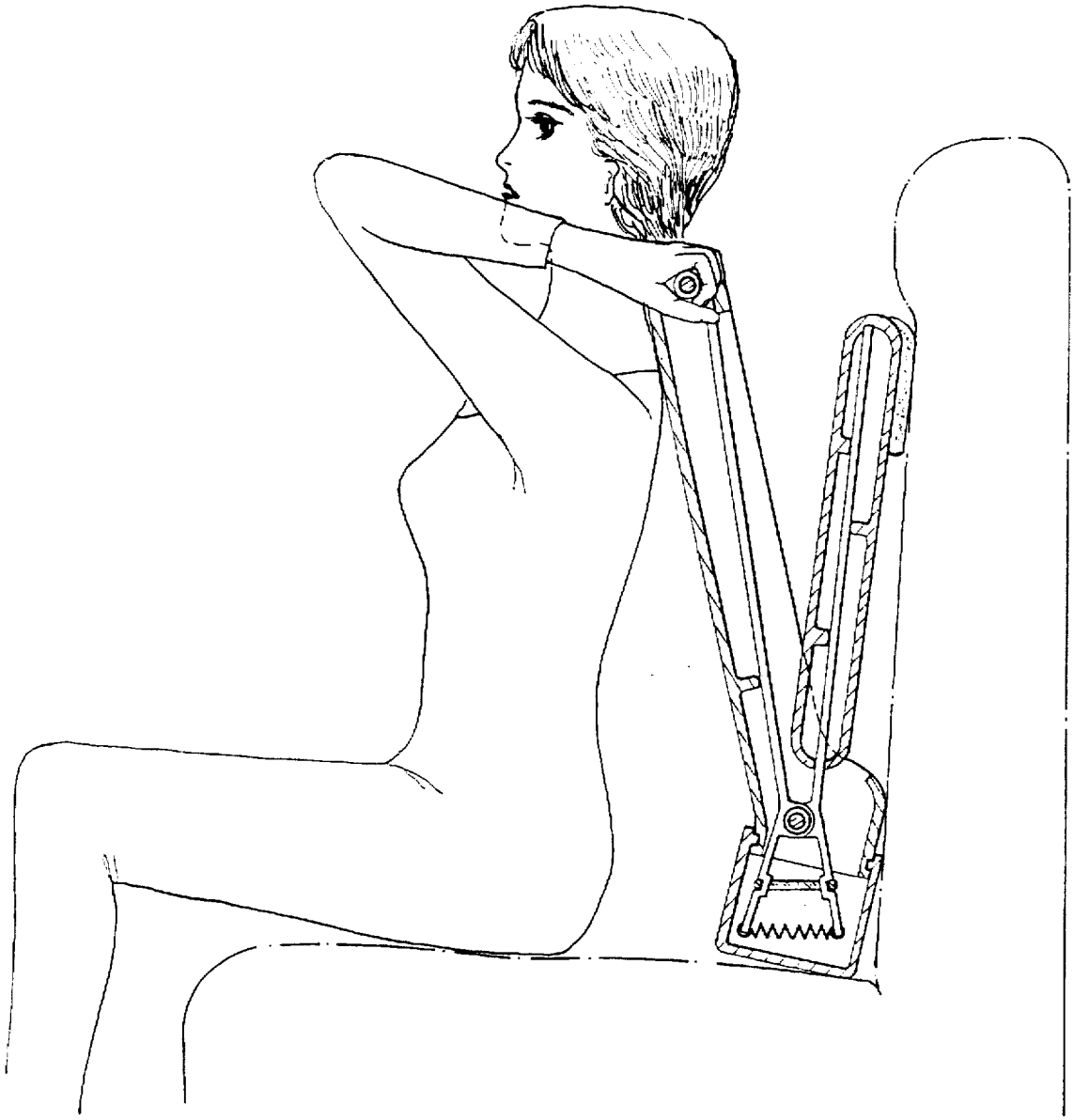
FIG. 7 is a second schematic view showing the operation of the body-building machine in accordance with the preferred embodiment of the present invention.
Figure 8:
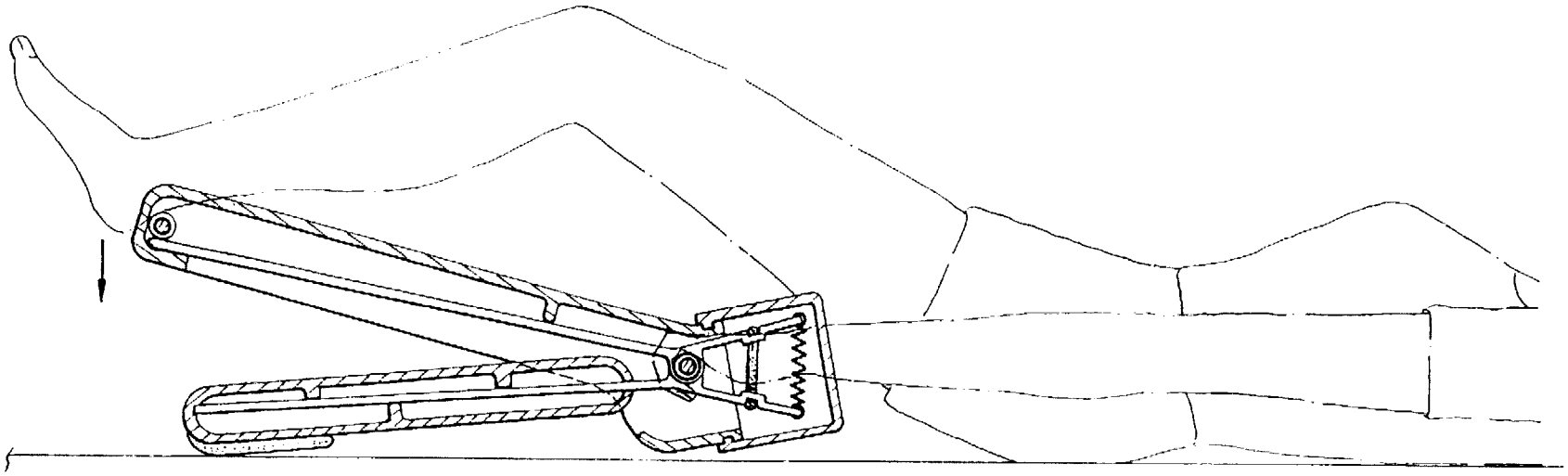
FIG. 8 is a third schematic view showing the operation of the body-building machine in accordance with the preferred embodiment of the present invention.

FIG. 4 to FIG. 8 are schematic views showing different operations of the body-building machine in accordance with the present invention. Referring to FIG. 4, a user may sit with backs of knees respectively applied onto the pair of sheathings 118 of the rod 117, two hands holding the two handles 26 of the shaft 25, and abdomen pressing against the bottom of the cladding plate 20. When the user bends forward, his/her abdomen will apply a force to the angled end portion 201, as shown by the arrow in FIG. 5. At this time, the angled end portion 201 will pivot about the shaft 25 and the extension springs 29 will elongate due to tension. When the user resumes to his/her original upright position, the force applied on the angled end portion 201 is removed, and the extension springs 29 of the elastic return means will reciprocate to a normal state. By means of repeating the above mentioned movement, the user can build his/her abdominal muscles. With the same principle as FIG. 4 and FIG. 5, the user can further build the arm, back and leg muscles (see FIGS. 6 and 8).

From the above description, it is appreciated that the improved body-building machine in accordance with the present invention may have effective physical training to the muscles of the whole body, without limitation of place and space. Therefore, it provides multiple functions for body-building. Moreover, it is easy to operate the body-building machine. Additionally, for children, the body-building machine is also adapted by adjusting the number of the extension springs 29.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A body-building machine comprising:

a locating frame having a head portion integrally formed at a top thereof, said head portion defining an open chamber therein and a pair of opposed holes at two side walls thereof;

a locating plate inserted into the open chamber of the head portion and received in the locating frame, said locating plate including a body with an inclined end portion extending therefrom and a pair of tubular lugs formed at an intersection between the inclined end portion and the body, passages in the tubular lugs aligning with the pair of opposed holes;

a cladding plate including a plank with an angled end portion extending therefrom and a tube formed at an intersection between the angled end portion and the plank, said tube aligning with the tubular lugs of the locating plate, the angled end portion of the cladding plate being received in the open chamber of the head portion of the locating frame;

a shaft inserted through the opposed holes of the locating frame, the pair of tubular lugs of the locating plate and the tube of the plank to engage the inclined end portion of the locating plate with the angled end portion of the plank and to form a short tension arm above shaft and a long tension arm below the shaft for the locating plate and the plank; and an elastic return means disposed between the inclined end portion of the locating plate and the angled end portion of the plank in the short tension arm portion.

2. A body-building machine as claimed in claim 1, wherein said inclined end portion of the locating plate and said angled end portion of the plank respectively define a pair of opposed recesses in respective outer peripheries thereof for a belt to extend therearound, and a plurality of opposed holes through which a corresponding number of extension springs are mounted.

3. A body-building machine as claimed in claim 1, wherein said head portion of the locating frame further defines a pair of opposed channels in an outer periphery thereof.

4. A body-building machine as claimed in claim 3, further including a cover disposed on the head portion of the locating frame and engagedly received in the channels.

5. A body-building machine as claimed in claim 1 and 3, wherein said opposed holes of the head portion of the locating frame are configured to be stepped holes.

6. A body-building machine as claimed in claim 1, wherein said shaft has a pair of handles formed on two ends which project from the head portion of the locating frame.

7. A body-building machine as claimed in claim 1, wherein said locating frame further defines a pair of holes at a bottom thereof, and the locating plate forms a sleeve at a bottom thereof aligning with the pair of holes of the locating frame for a rod to extend therethrough, thereby engaging the locating plate to the locating frame.

8. A body-building machine as claimed in claim 7, wherein said rod has a pair of sheathings mounted on two ends which project from the locating frame.

9. A body-building machines as claimed in claim 1, wherein said cladding plate has a pad mounted on a bottom thereof.

* * * * *